US011774050B2

(12) United States Patent
Boroski

(10) Patent No.: US 11,774,050 B2
(45) Date of Patent: Oct. 3, 2023

(54) CONFIGURABLE MODULAR LIGHTING SYSTEM

(71) Applicant: Universal LED Lighting Plates, LLC, Maple Heights, OH (US)

(72) Inventor: Alan Boroski, Maple Heights, OH (US)

(73) Assignee: Universal LED Lighting Plates, LLC, Maple Heights, OH (US)

( * ) Notice: Subject to any disclaimer, the term of this patent is extended or adjusted under 35 U.S.C. 154(b) by 0 days.

(21) Appl. No.: 17/710,142

(22) Filed: Mar. 31, 2022

(65) Prior Publication Data

US 2022/0364690 A1 Nov. 17, 2022

Related U.S. Application Data

(60) Provisional application No. 63/187,604, filed on May 12, 2021.

(51) Int. Cl.

| | |
|---|---|
| ***F21S 2/00*** | (2016.01) |
| ***F21S 8/04*** | (2006.01) |
| ***F21S 4/28*** | (2016.01) |
| ***F21S 8/00*** | (2006.01) |
| ***F21Y 115/10*** | (2016.01) |

(52) U.S. Cl.

CPC ..... *F21S 2/005* (2013.01); *F21S 4/28* (2016.01); *F21S 8/031* (2013.01); *F21S 8/046* (2013.01); *F21Y 2115/10* (2016.08)

(58) Field of Classification Search

CPC ..... F21V 27/00; F21V 27/02; F21V 19/008; F21V 19/0085; F21V 19/009; F21V 23/001; F21V 23/02; F21V 23/023; F21V 15/01; F21Y 2115/10; F21S 8/031; F21S 4/28

See application file for complete search history.

(56) References Cited

U.S. PATENT DOCUMENTS 4,070,571 A * 1/1978 Robertson ..... H01J 5/48 362/217.08

FOREIGN PATENT DOCUMENTS

FR 2595012 A1 * 2/1986
WO WO-2019097224 A1 * 5/2019 ..... F21S 2/005

* cited by examiner

*Primary Examiner* — Anabel Ton
(74) *Attorney, Agent, or Firm* — Ulmer & Berne LLP; John X. Garred

(57) ABSTRACT

A system and method for providing robust, configurable lighting includes electrical boxes interconnected by conduit through selected knockout openings. A cover plate includes multiple rectangular openings oriented if different fashions. The openings are configured to receive and secure a base of tubular lighting element to the cover plate. Wiring is passed through the conduit into the boxes, and a connection is made to the lighting element through a secured base and associated opening.

9 Claims, 7 Drawing Sheets

CONFIGURABLE MODULAR LIGHTING SYSTEM

TECHNICAL FIELD OF THE INVENTION

This application relates generally to lighting systems. The application relates more particularly to configurable lighting arrays adapted for use in industrial applications.

BACKGROUND OF THE INVENTION

Lighting systems, particularly systems designed for industrial environments, can be prohibitively expensive to install or replace. Industrial lighting is subject to additional regulation under both federal and state laws in the United States. For example, the U.S. Occupational Safety and Health Administration (OSHA) requires all light fixtures to have protective plates. If light fixtures are in an area where they could be damaged, they must be guarded by strong barriers to prevent shattering. This is also required for covers of pull boxes, junction boxes and fittings. Further OSHA requirements specify that lighting cannot have any exposed, live parts and cannot have an opening large enough for a finger. OSHA can inspect a premises and issue penalties for non-compliance.

Further regulations, such as energy use restrictions, may apply to new lighting installations or replacement installations.

BRIEF DESCRIPTION OF THE DRAWINGS

Various embodiments will become better understood with regard to the following description, appended claims and accompanying drawings wherein:

DETAILED DESCRIPTION OF THE INVENTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

Figure 1:
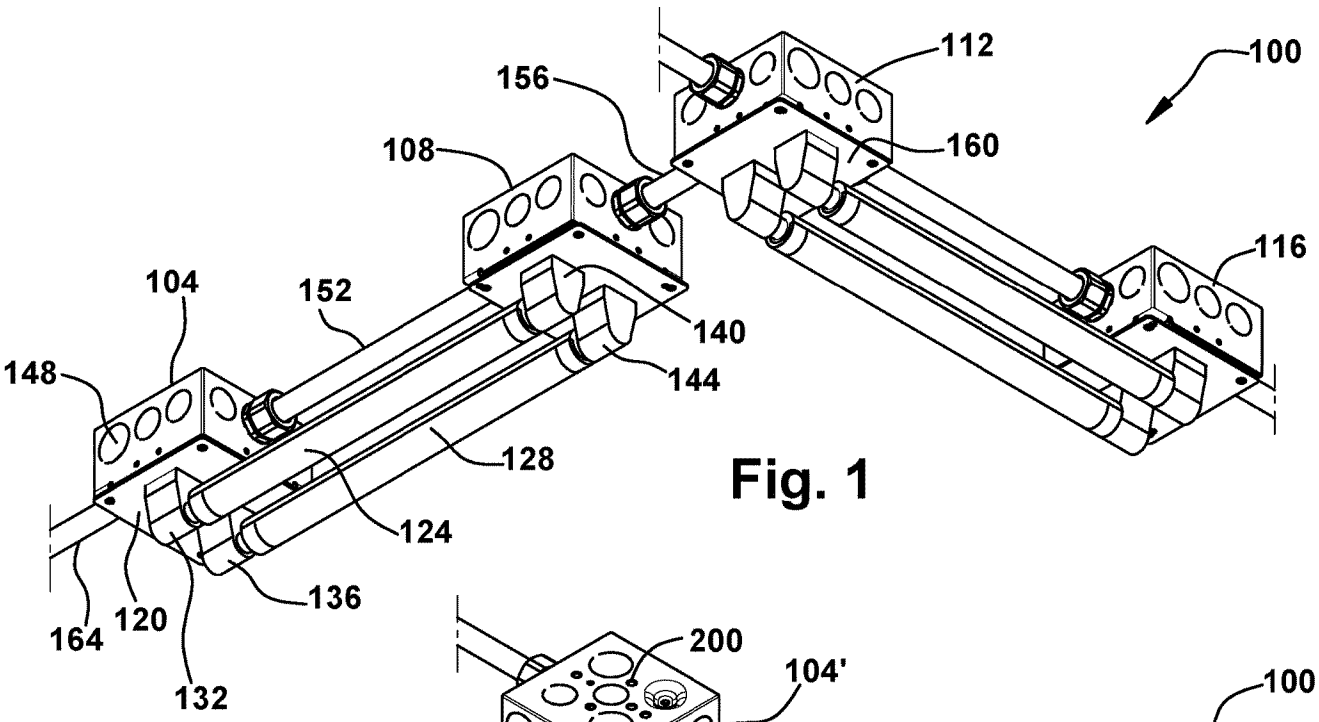
FIG. 1 illustrates a bottom, perspective view of an example embodiment of a subsection 100 of a modular lighting.

Example embodiments herein include a configurable, modular lighting system suitable for use in hardened environments, such as factory floors. FIG. 1 illustrates a bottom, perspective view of an example embodiment of a subsection 100 of a modular lighting system constructed with use of existing and approved electrical components including electrical boxes 104, 108, 112 and 116. Configuration of the electrical boxes is analogous in the illustrated example. Referring to box 104, a cover 120 is affixed to an open side. Cover plate 120 secures distal ends of elongated lighting units 124 and 128 via bases 132 and 136, respectively. As will be detailed further below, bases 132 and 136 are secured to oblong slots, suitably rectangular, in cover plate 120 to facilitate electrical connection to lighting units 124 and 128. Lighting units described herein are comprised of any suitable lighting source, such as incandescent, fluorescent, halogen, or light emitting diode (LED). Example embodiments illustrated herein are described with LED lighting insofar as it has advantages of high efficiency and long life.

Opposed distal ends of LED lights 124 and 128 are secured to box 108 via bases 140 and 144, and by bases 132 and 136 analogously to box 104. Electrical connections between bases is provided via conduit affixed to knockouts, such as knockout 148 of box 104. Each box has a plurality of knockouts which facilitates orientation of an array of lights in a desired fashion. In the illustrated example, conduit 152 provides an electrical pathway between an interior of box 104 and an interior of box 108, which boxes cooperatively support LED lights 124 and 128. Conduit 156 provides an electrical pathway between boxes 108 and 112. Selective use of knockouts and conduit lengths facilitate construction of a lighting array in multiple orientations, such as orthogonally as illustrated. It is understood that faceplates can be affixed to boxes to facilitate orientation of associated LED lights as desired. In the illustrated example, oblong openings in faceplate 160 of box 112 are orthogonal to those of faceplate 120 which is accomplished by affixing faceplate 160 by rotating it 90 degrees relative to that of faceplate 120. Electrical power to the modular lighting system is via a connection to any suitable power source, suitably via conduit 164.

Figure 2:
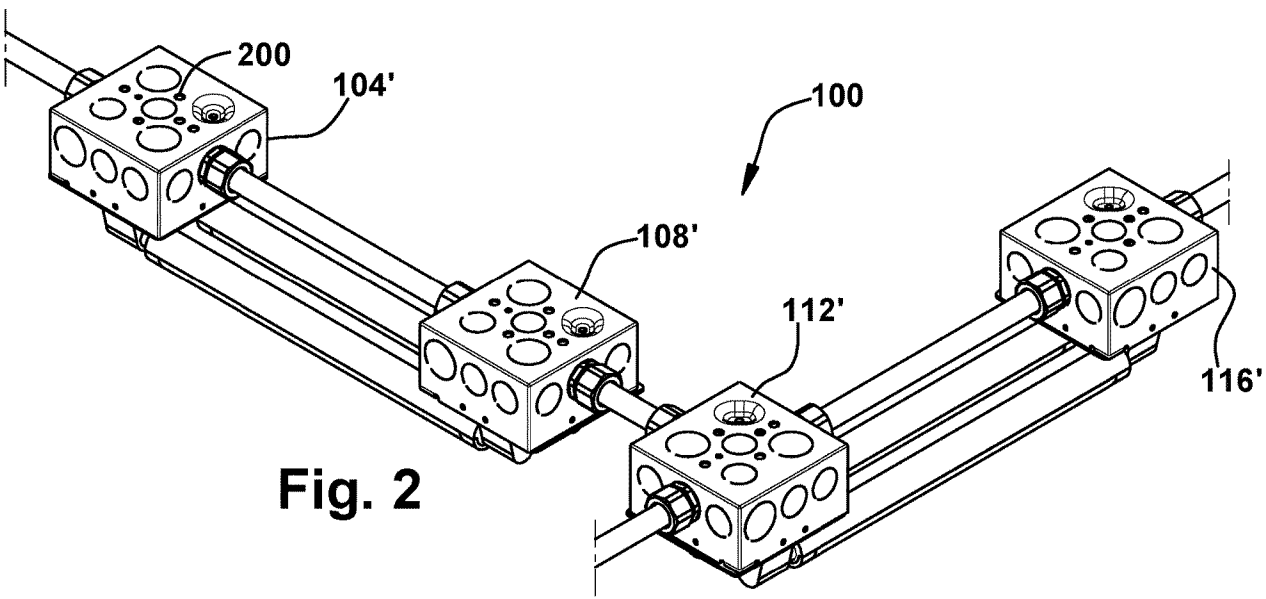
FIG. 2 is a top, perspective view of the lighting array of FIG. 1.
Figure 3:
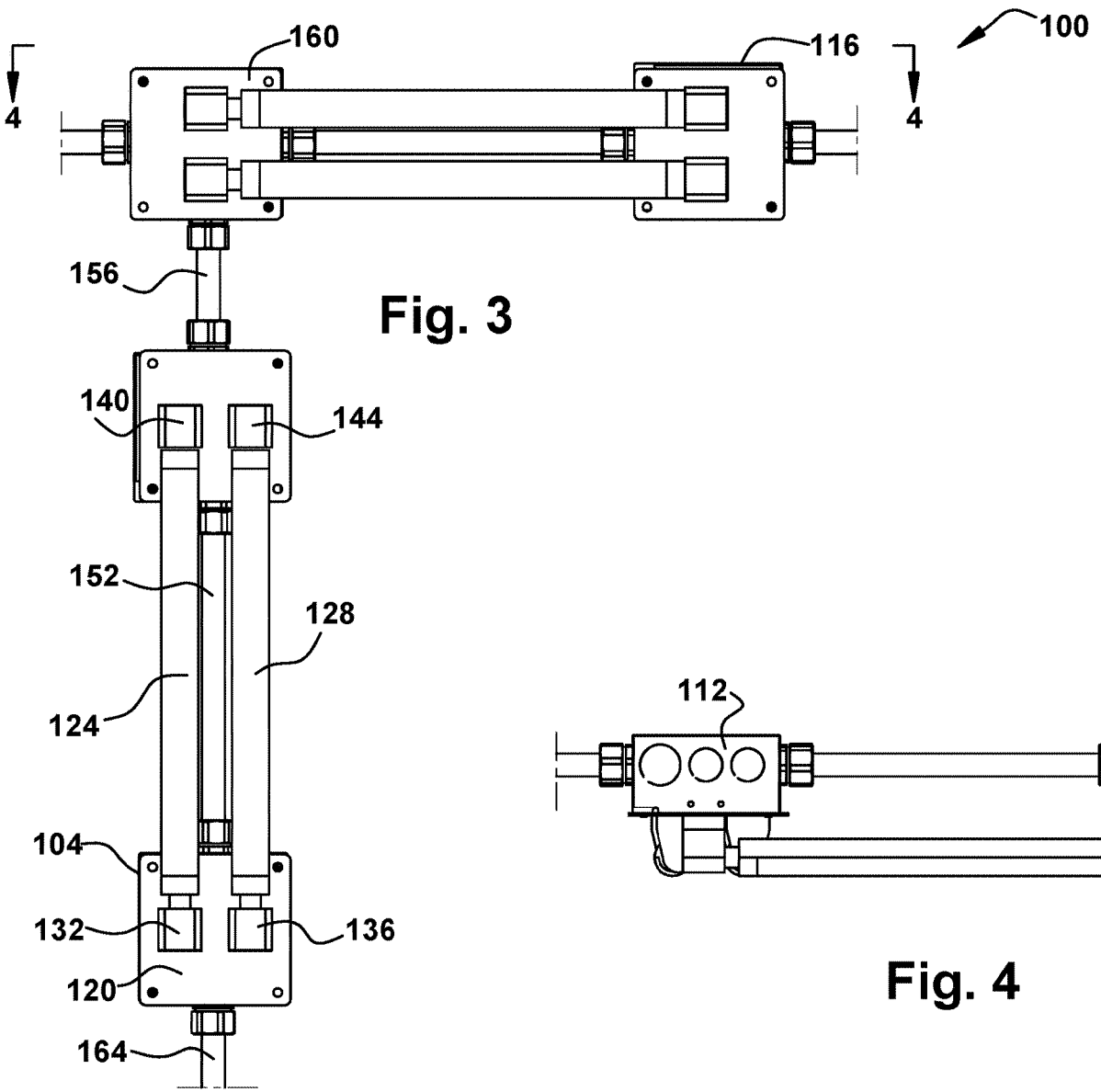
FIG. 3 is a bottom, plan view of the lighting array of FIG. 1.
Figure 4:
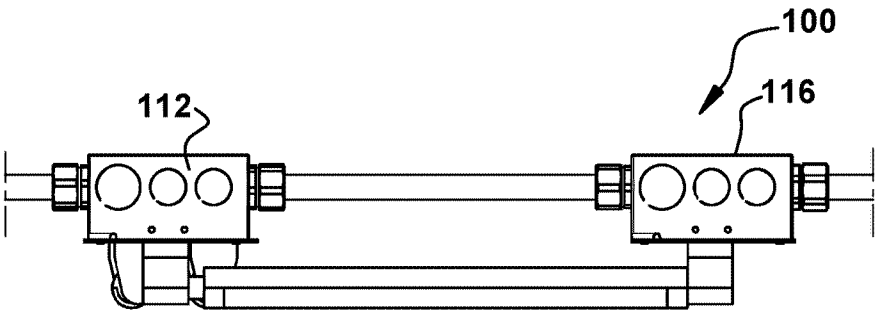
FIG. 4 is a side, plan view of the lighting array of FIG. 1.

FIG. 2 is a top, perspective view 100 of lighting array 100 of FIG. 1. Electrical boxes are suitably affixed to a ceiling via fasteners applied through holes, such as hole 200 of box 104'. FIG. 3 is a bottom, plan view of lighting array 100 of FIG. 1. FIG. 4 is a side view of lighting array 100 of FIG. 1.

Figures 5, 6:
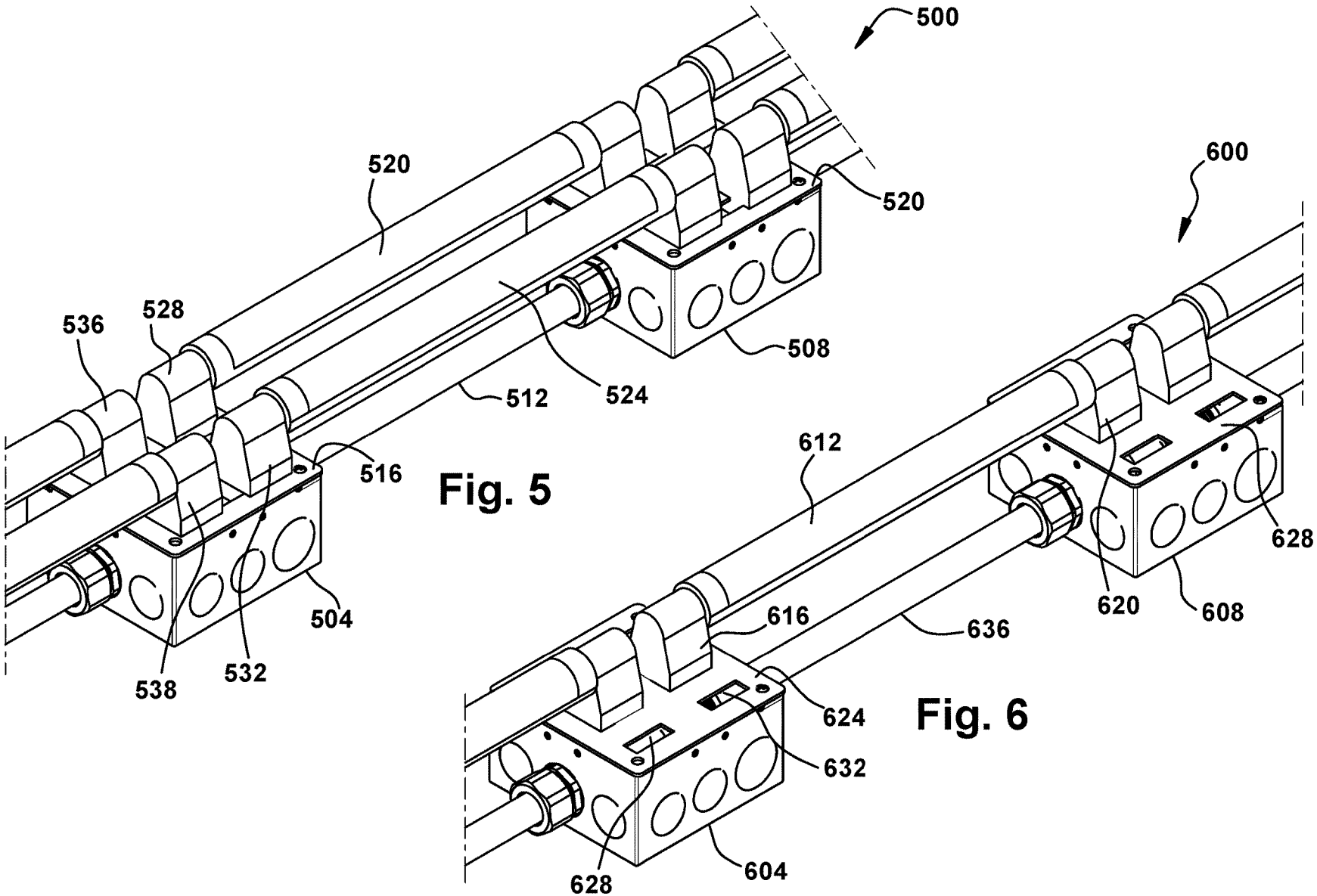
FIG. 5 is a perspective view of a lighting array comprising a linear arrangement of paired lighting elements.
FIG. 6 is a perspective view of a lighting array comprising a linear arrangement of single lighting elements.

FIG. 5 is a perspective view of lighting array 500 comprising a linear arrangement of paired lighting elements. Box 504 and 508 are electrically connected via conduit 512. Cover plate 516 is affixed to box 504 and supports LED lights 520 and 524 via bases 528 and 532. Cover plate 516 includes four oblong openings, facilitating connection with additional LED lights via bases 536 and 538. Face plates suitably have four or six oblong openings arranged in to sets of three linearly oriented openings. In the example, four openings are used. It is to be appreciated that the array can be comprised of as many light sections as needed for a particular installation.

Figure 7:
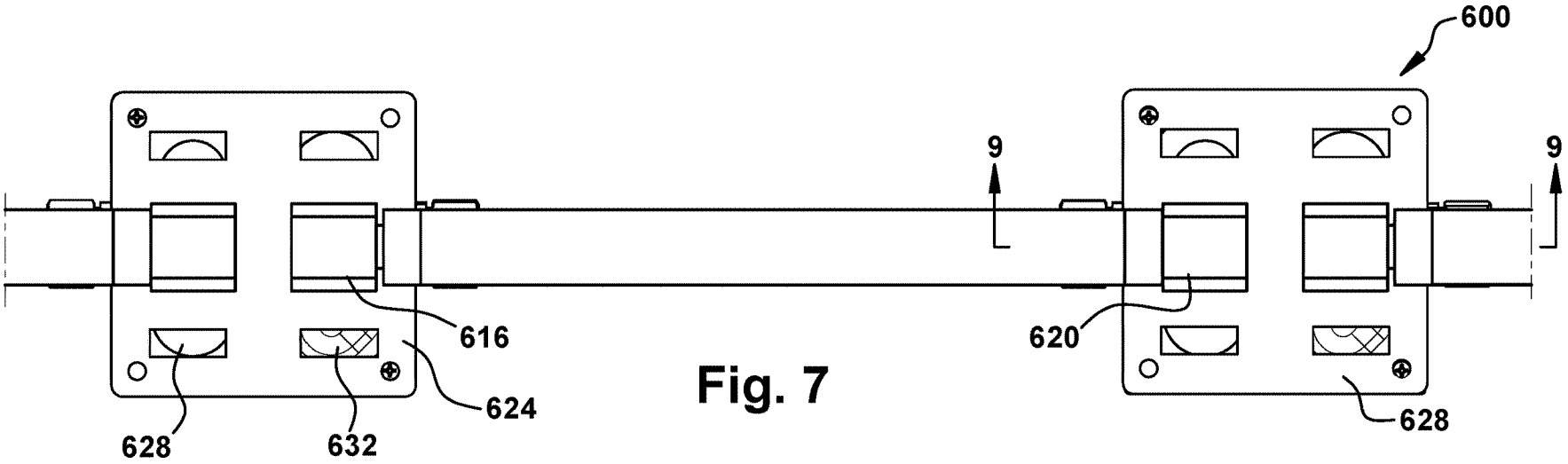
FIG. 7 is a bottom, plan view of the lighting array of FIG. 6.
Figure 8:
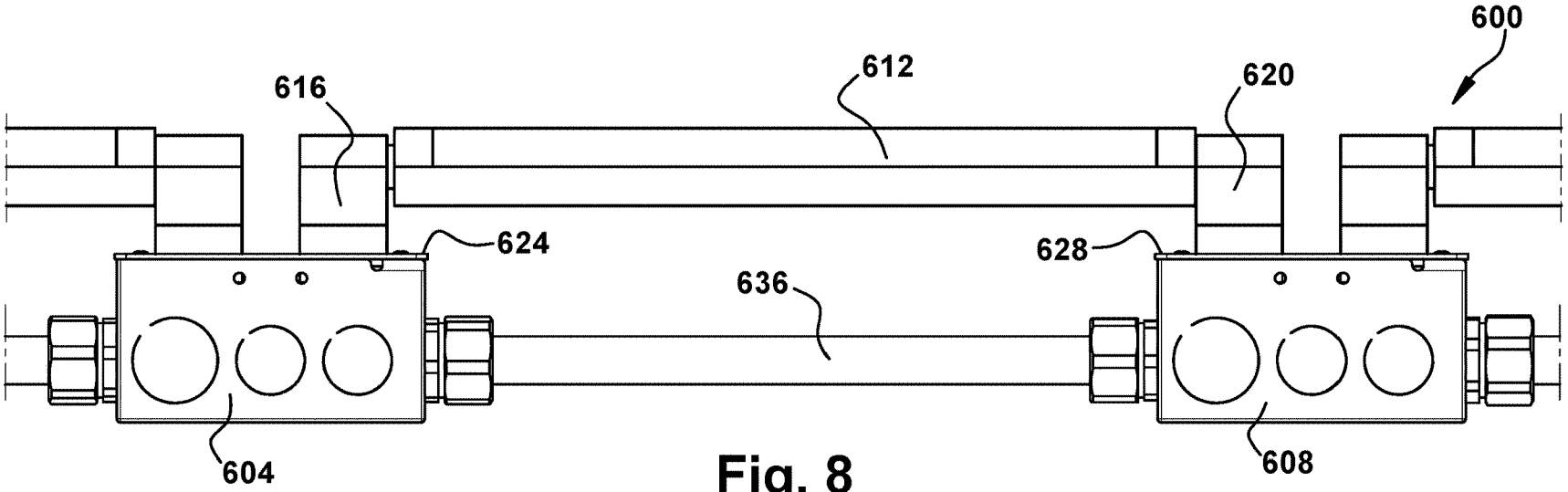
FIG. 8 is a side, plan view of lighting array 600 of FIG. 6.

FIG. 6 is a perspective view of lighting array 600 comprising a linear arrangement of single lighting elements. Boxes 604 and 608 cooperatively support light element 612 via bases 616 and 620, which in turn are supported by cover plates 624 and 628. The illustrated cover plates comprise six oblong openings, such as rectangular openings 628 and 632. In the illustrated example, only two, central openings are used on each box to accomplish the linear array. Boxes 604 and 608 are electrically connected via conduit 636. Conduit 636 passes through an opening resultant from a knockout removed from box 604. Box 604 and conduit 636 are secured to one another via coupling 644, comprised of any suitable connector such as a threaded or compression fitting. Lighting elements, are fed from a power source via any suitable conductor FIG. 7 is a bottom, plan view of lighting array 600 of FIG. 6. FIG. 8 is a side, plan view of lighting array 600 of FIG. 6.

Figure 9:
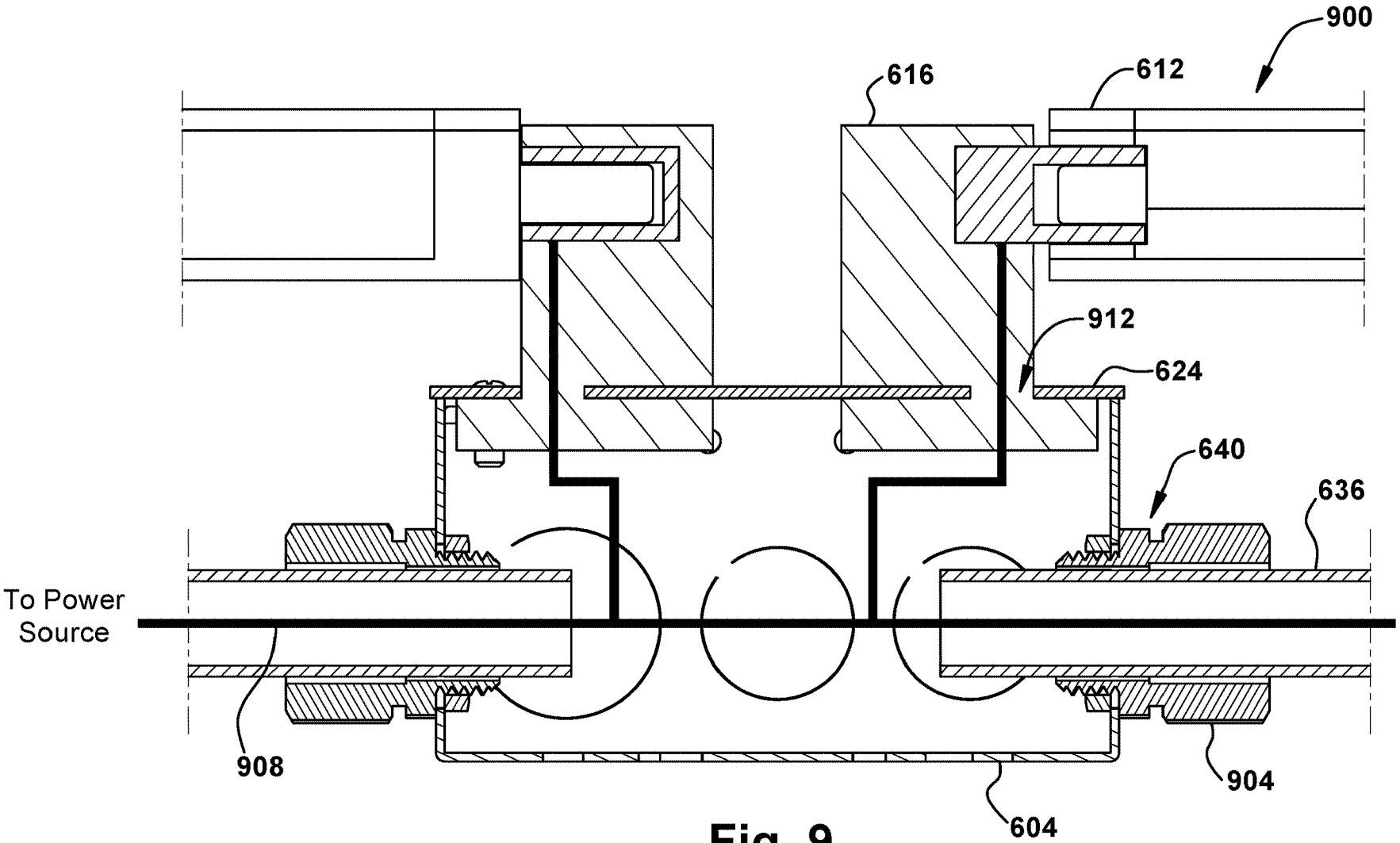
FIG. 9 is a cut away view of an electrical box forming an element in a lighting array.

FIG. 9 is a cut away view of a box, such as box 604 of FIG. 6. Conduit 636 connects with an interior of box 604 via an opening 640 from a removed knockout. Conduit 636 is affixed to box 604 with any suitable coupling such threaded coupling 904. Power conductor 908 is suitably comprised of any suitable wiring, and relays power to lighting elements, such as lighting element 612 by extending through cover plate opening 912 and base 624.

Figure 10:
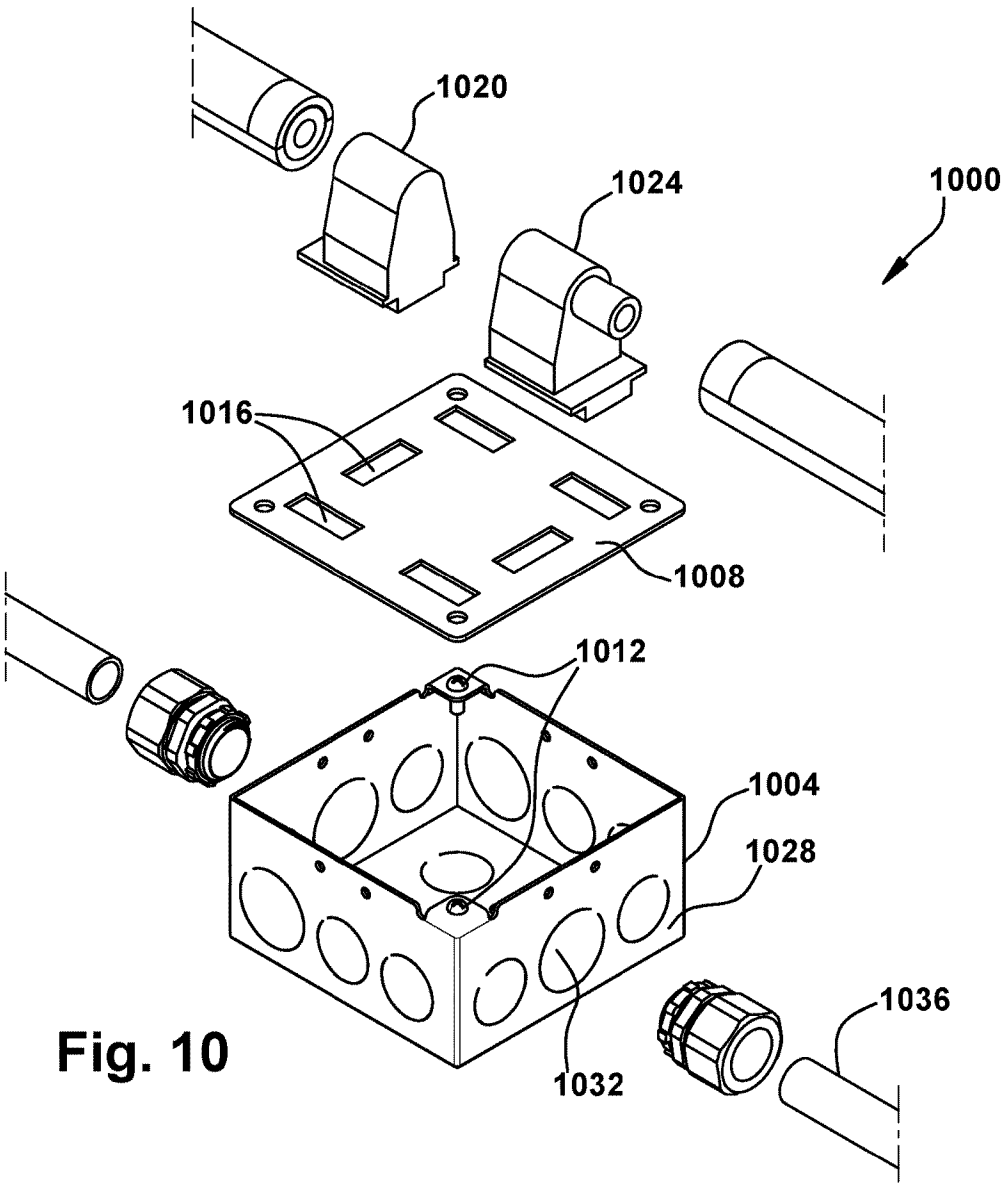
FIG. 10 is an exploded view of an example embodiment of a lighting array element.

FIG. 10 is an exploded view 1000 of an example embodiment of a lighting array element. Box 1004 is configured to fixedly receive cover plate 1008 via fasteners 1012. Cover plate 1008 includes a plurality of openings 1016, suitably comprised of aligned and oriented rectangular openings. Bases 1020 and 1024 can be aligned with any opening to facilitate construction of a desired array. Side wall 1028 of box 1004 includes a plurality of knockouts, such as knockout 1032 that can be removed to accommodate conduit 1036 via coupling 1040.

Figure 11:
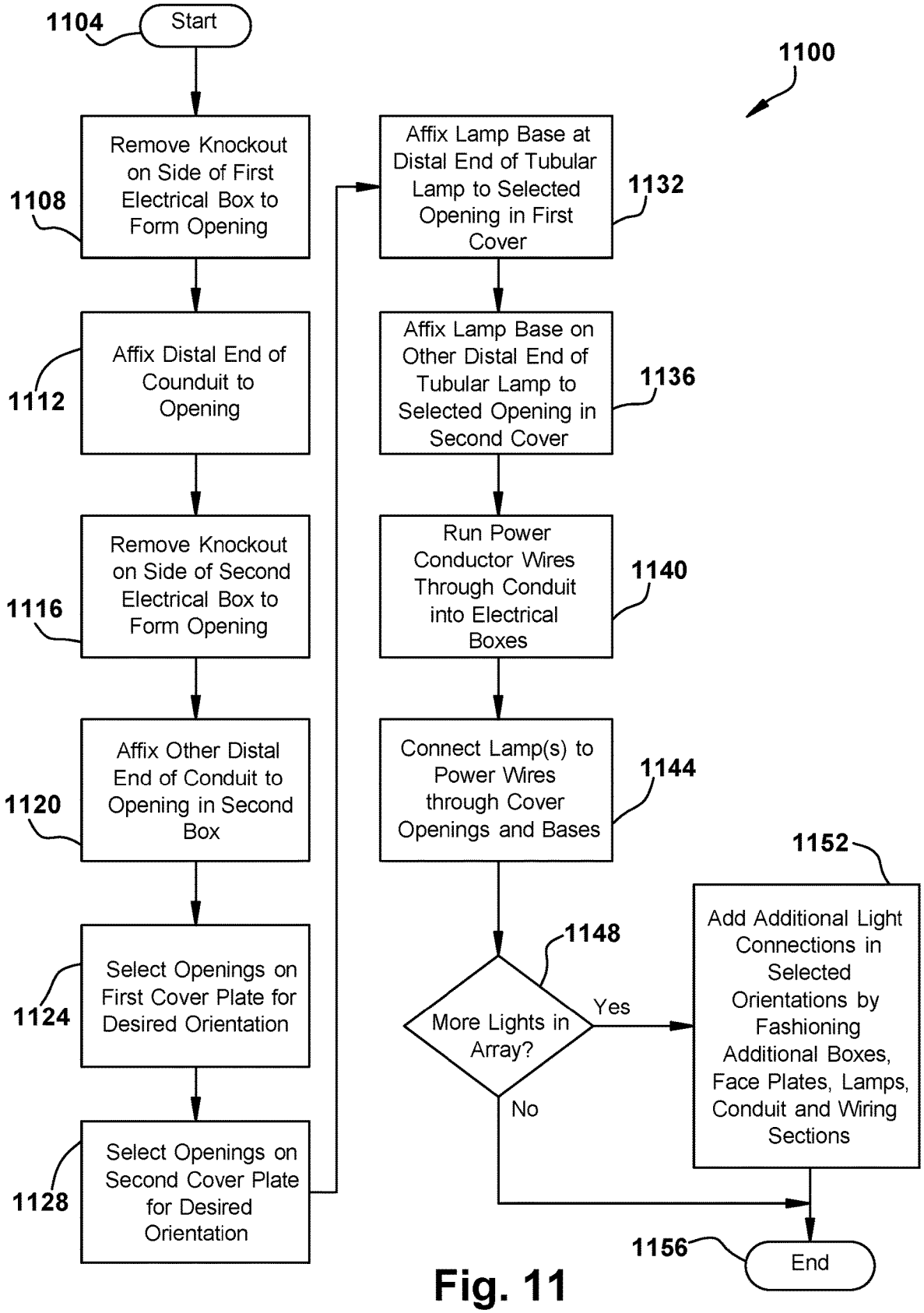
FIG. 11 is a flowchart of an example embodiment of a system for constructing a customized array of lighting elements.

FIG. 11 is a flowchart 1100 of an example embodiment of a system for constructing a customized array of lighting elements. The processes commences at block 1104 and proceeds to block 1108 where a knockout is removed from a side of a first electrical box to form an opening. A distal end of a conduit is affixed to this opening at block 112. A knockout is removed from a side of a second electrical box at block 1116. The other distal end of the conduit is affixed to the second box at block 1120. Cover plate openings are selected for cover plates associated with both boxes at blocks 1124 and 1128. Lamp bases are affixed to both cover plates at selected openings at block blocks 1132 and 1136. Power wiring is run thorough both boxes and conduit at block 1140 and the wiring is connected to the lamps at block 1144. A determination is made at block 1140 as to whether the array is complete or if more elements are desired. If more are desired, the elements are added analogously at block 1152 before the process ends at block 1156. If the array is complete, at block 1148, the process proceeds to termination at block 1156.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the spirit and scope of the inventions.

What is claimed is:

1. A system comprising:

a plurality of electrical boxes, each electrical box having an interior portion formed by a bottom wall and an opening disposed from the bottom wall by one or more side walls, each side wall having one or more knockouts;

a conduit extending between a first electrical box and a second electrical box, the conduit affixed to a removed knockout of the first electrical box at a first end of the conduit and affixed to a removed knockout of the second electrical box;

the conduit configured to contain first and second conductor wires extending between the first electrical box and the second electrical box via an interior of the conduit;

the first electrical box configured to receive feeder wiring from an associated power source;

first and second removable face plates configured to be affixed to cover each of at least the first and second electrical boxes respectively, each face plate including one or more openings configured to secure a mount associated with a distal end of a tubular light source and facilitate a power connection between one or more conductor wire and an associated distal end of the tubular light source;

a third electrical box having an interior portion formed by a bottom wall and an opening disposed from the bottom wall by one or more side walls, each side wall having one or more knockouts;

a second conduit extending between the second electrial box and the third electrical box, the conduit affixed to a removed knockout on the third electrical box and a second removed knockout on the second electrical box; and a removable faceplate configured to be affixed to cover the third electrical box, the faceplate including one or more openings configured to secure a mount on a second distal end of the second tubular light source;

wherein a base of a first distal end of the tubular light source is secured to a first opening in the first electrical box and wherein a base of a second distal end of the tubular light source is affixed at a first opening of the second electrical box;

wherein the second faceplates includes at least a second opening configured to secure a mount associated with a first distal end of a second tubular light source; and wherein the first and second conductor wires further extend between the second electrical box and the third electrical box via an interior of the second conduit.

2. The system of claim 1 wherein an angular orientation of the first conduit relative to the second conduit is determined by an orientation of the first opening on the second removable face plate relative to an orientation of the second opening of the second removable face plate.

3. The system of claim 2 wherein the first conduit is angled relative to the second conduit.

4. The system of claim 3 wherein the first conduit is collinear with the second conduit.

5. The system of claim 3 wherein the first conduit orthogonal to the second conduit.

6. The system of claim 3 wherein each opening is an oblong rectangle.

7. The modular lighting system of claim 1 wherein a covered electrical box includes a first base secured to a first oblong opening and a second base secured to a second, parallel oblong opening, wherein a lighting element secured to the first base is parallel to a lighting element secured to the second base.

8. The modular lighting system of claim 7 wherein both lighting elements extend from the same side of the covered electrical box.

9. The modular lighting system of claim 7 wherein the lighting elements extend from opposed sides of the covered electrical box.

* * * * *